United States Patent [19]

Lenzing

[11] Patent Number: 4,560,970

[45] Date of Patent: Dec. 24, 1985

[54] VARIABLE TRANSFORMER WITH MULTI-LAYER COIL

[75] Inventor: Richard S. Lenzing, Farmington, Conn.

[73] Assignee: The Superior Electric Company, Bristol, Conn.

[21] Appl. No.: 648,481

[22] Filed: Sep. 7, 1984

[51] Int. Cl.[4] ..... H01F 21/02; H01F 29/06; H01F 41/06

[52] U.S. Cl. ..... 336/149; 29/605

[58] Field of Search ..... 336/148, 149, 150, 198, 336/208; 338/162, 174, 176, 185, 160; 323/255, 340; 29/605, 606

[56] References Cited

U.S. PATENT DOCUMENTS

| | | | |
|---|---|---|---|
| 2,810,887 | 10/1957 | Ecklund et al. | 336/198 X |
| 3,278,877 | 10/1966 | Kameya et al. | 336/198 X |
| 3,365,686 | 1/1968 | Peterson | 336/144 X |
| 3,497,848 | 2/1970 | Corrigall | 338/185 X |
| 4,189,672 | 2/1980 | Peschel | 336/149 X |

FOREIGN PATENT DOCUMENTS

| | | | |
|---|---|---|---|
| 417335 | 8/1925 | Fed. Rep. of Germany | 336/149 |
| 453036 | 11/1927 | Fed. Rep. of Germany | 336/208 |

*Primary Examiner*—Thomas J. Kozma
*Attorney, Agent, or Firm*—John H. Crozier

[57] ABSTRACT

A coil for a variable transformer is provided having multiple layers of wire. Winding of such a coil is facilitated by providing an end form having a series of raised fins, or partitions, between which stacked layers of wire are held. The construction provides for easy and economical machine-winding and ensures that the segments of wire forming the commutating surface are held relatively immovable with respect to each other, thus preserving the integrity of the commutating surface.

3 Claims, 5 Drawing Figures

FIG. 2 (PRIOR ART)
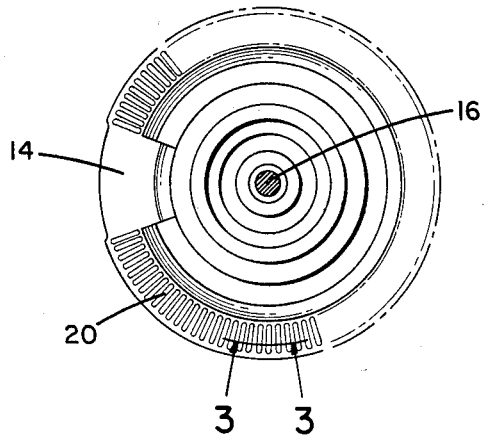
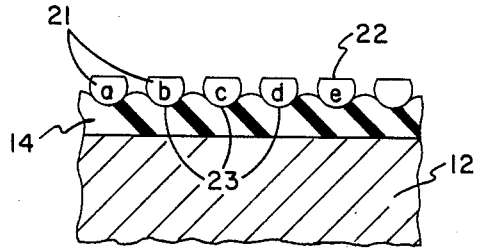
FIG. 3a (PRIOR ART)
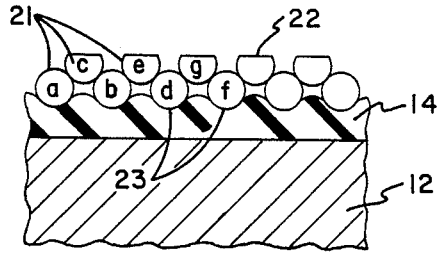
FIG. 3b (PRIOR ART)
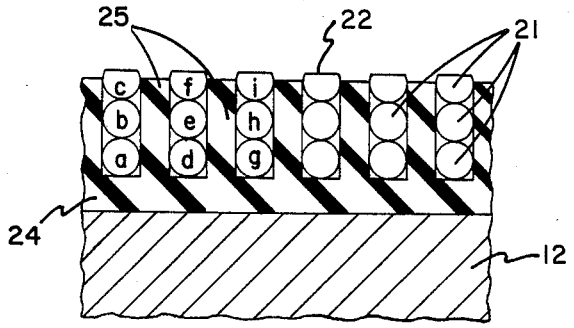
FIG. 3c

VARIABLE TRANSFORMER WITH MULTI-LAYER COIL

BACKGROUND OF THE INVENTION

1. Field of the Invention

This invention relates to variable transformers of the type having a wire coil wound upon an electromagnetic core and having upon the coil a commutating surface along which a contact brush is movable while in electrical engagement therewith, and more particularly to means for reducing the size of the electromagnetic core required for a given size transformer.

2. Description of the Prior Art

Variable transformers are well known in the art and typically, though not invariably, include a toroidal wire coil which is machine-wound upon a magnetic core of similar toroidal shape. In most such devices, the coil is wound so that there is a single layer of wire at the outer diameter of the toroid and a double layer of wire at the inner diameter of the toroid. Such an arrangement is used to facilitate winding a nearly perfect, sequentially-wound coil so that the commutating surface may be formed on the upper surface of segments of wire forming the single layer, by grinding partially through wire segments in the commutator path. Such coils having fine wire use many times more electromagnetic core material relative to the amount of wire. If multiple layers of wire could be economically wound into a nearly perfect, sequentially-wound coil under the commutating surface, relatively more wire and less electromagnetic core material could be used for a given transformer capacity and would result in a smaller, more economical coil. Heretofore, variable transformer coils wound with more than one layer of wire have proved to be difficult to machine-wind, resulting in high reject rates.

SUMMARY OF THE INVENTION

The present invention facilitates the sequential winding of a transformer coil having two or more layers of wire, which is easily and economically wound, by providing an end form having a series of fins, or partitions, which separate and hold adjacent stacks of turns of wire. The end form also ensures that the wire segments forming the commutating surface are held relatively immovable with respect to each other, thus preserving the integrity of the commutating surface.

BRIEF DESCRIPTION OF THE DRAWINGS

FIG. 2 is a partially cut-away section of the autotransformer taken at plane 2—2 of FIG. 1, showing the upper surfaces of the coil and core end form.

FIG. 3*a* is an enlarged, partial cross-section of the transformer coil taken at plane 3—3 of FIG. 2, showing conventional construction with one layer of wire.

FIG. 3*b* is an enlarged, partial cross-section of the transformer coil taken at plane 3—3 of FIG. 2, showing conventional construction with two layers of wire.

FIG. 3*c* is an enlarged, partial cross-section of the transformer coil taken at plane 3—3 of FIG. 2, showing the construction of the present invention.

DESCRIPTION OF THE PREFERRED EMBODIMENT

Figure 1:
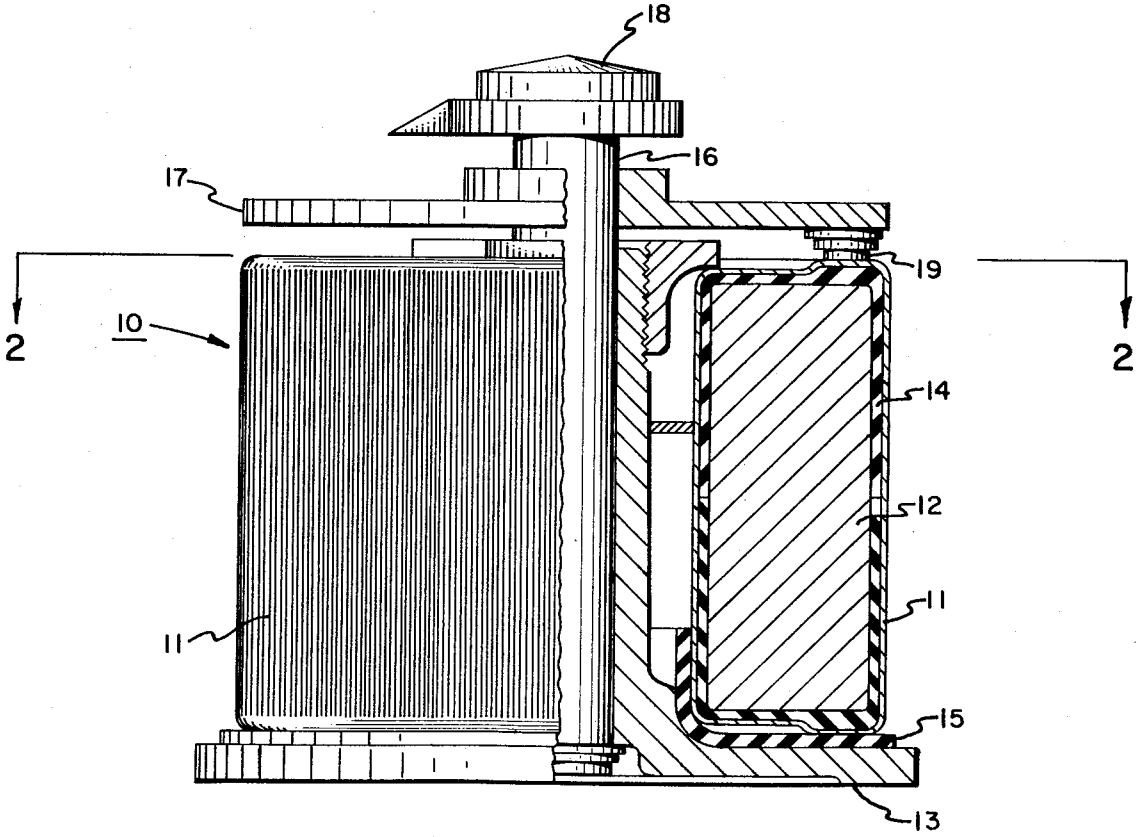
FIG. 1 (PRIOR ART)
FIG. 1 is a partially cut-away view showing the major elements of a toroidally-shaped variable autotransformer.

Referring to FIG. 1, one type of variable transformer, a variable autotransformer, is indicated generally by the numeral 10 and includes a coil 11 wound upon a toroidal electromagnetic core 12 and mounted upon a base 13. End forms 14 electrically insulate the coil from the core and provide the surface upon which the coil is directly wound. An electrical insulator 15 is placed between the coil and the base. A shaft 16 is located for rotation centrally of the coil. Mounted upon the shaft is a radiator plate 17 and a knob 18 to permit manual rotation of the shaft and the radiator plate. The radiator plate 17 carries a contact brush 19.

Referring to FIG. 2, an arcuate commutating path 20 is provided along which the contact brush 19 (See FIG. 1) is moved while in electrical engagement therewith.

FIG. 3*a* shows, in detail, the layer of wire segments 21 along which the commutating surface is formed in a conventional variable autotransformer having a single layer of wire at the commutating surface, as at 22. An arcuate series of evenly spaced grooves 23 is provided near the outer edge of the end form to hold adjacent turns of the coil. The commutating surface is formed by grinding through the upper surface of the wire segments. Winding, and particularly machine-winding, is facilitated by the provision of the adjacent grooves. Each segment shown is part of the sequentially wound coil; that is, the turn associated with segment b is formed after segment a, then segment c, then segment d, etc.

FIG. 3*b* shows a similar detail of a conventional variable autotransformer coil having two layers of magnet wire 21. The commutating surface is formed on the upper layer of wire, as at 22. Here, it will be appreciated that machine-winding of the coil is considerably more complicated than with a single-layer coil. The turns associated with segments a and b are formed in sequence, then the winding machine must index backwards to form the turn associated with segment c which must be placed on top of and between the turns associated with segments a and b, then forward for d, then backwards for e, etc. This is a relatively complicated winding procedure which produces a high percentage of coils with unsatisfactory commutating surfaces because of misplaced wire, especially when coils of small diameter wire, which may be on the order of 0.024 inch, are used.

FIG. 3*c* shows a similar detail of a variable autotransformer having an end form 24 of the present invention. The end form includes adjacent, relatively high, fins or partitions, 25 spaced apart a distance approximately equal to the diameter of the magnet wire to accommodate therebetween layers of wires. The commutating surface 22 is formed on the outer layer of wires in a manner similar to that of FIGS. 3*a* and 3*b*. It will be appreciated that, although three layers of wire are shown in FIG. 3*c*, any desired number of layers may be accommodated by appropriately selecting the height of the partitions 24. The partitions are desirably spaced so that the wire closely fills the interstices, thus holding the wires relatively firmly in place.

With such a construction as shown in FIG. 3*c*, the multi-layer coil may be easily wound with a slightly modified conventional winding machine. When winding a coil around the finned end forms of the present invention, the machine would dispense the desired number of layers between adjacent fins such as a, b, and c, index to the next position, dispense an identical number of turns, d, e, and f, etc., until the coil was completely wound. The fins hold the wires in proper sequence to form the commutating path and in the configuration shown in FIG. 3, a portion of every third turn of wire forms part of the commutating path. Without the fins, one layer of wire would have to be perfectly stacked upon another layer; the winding process would be slow, would create many imperfect, unusable coils, and would thus be expensive. It will be appreciated that the ratio of wire to magnetic core material is much higher in an autotransformer constructed according to the present invention than in a conventionally-constructed autotransformer.

It will be understood that what has been disclosed is an autotransformer with a coil having more than one layer of wire under the commutator path, which coil may be economically machine-wound, and in which, after winding, the wire segments forming the commutating path will be held relatively immovable with respect to each other, thus preserving the integrity of the commutating path.

Since certain changes may be made in carrying out the above invention without departing from the scope thereof, it is intended that all matter contained in the above description or shown in the accompanying drawing shall be interpreted as illustrative and not in a limiting sense.

It is also intended that the following claims are intended to cover all of the generic and specific features of the invention herein described, and all statements of the scope of the invention which, as a matter of language, might be said to fall therebetween.

I claim:

1. In a variable transformer of the type having a coil of successive turns of wire wound upon a core, with a commutating surface on the face of the coil with which a movable brush is in electrical engagement, an end form comprising:

a. a first portion of the end form which insulates the core from the coil;

b. a second portion of the end form which comprises a row of partitions substantially under the commutating surface, the interspaces of which partitions are essentially equal to diameter of the wire, and which partitions are of such height and orientation that a plurality of successive turns of the coil are held in each interspace, with sections of the topmost turns of wire comprising the commutating surface and all of the turns, including the turns forming the commutating surface, being between the partitions.

2. In a variable transformer of the type having a coil of successive turns of wire wound upon a core, with a commutating surface on the face of the coil with which a movable brush is in electrical engagement, an improved end form comprising:

a row of partitions substantially under the commutating surface, the interspaces of which partitions are essentially equal to the diameter of the wire, and which partitions are of such height and orientation that a plurality of successive turns of the coil are held in each interspace, with sections of the topmost turns of wire comprising the commutating surface and all of the turns, including the turns forming the commutating surface, being between the partitions.

3. A method of winding a wire coil for a variable transformer of the type having the coil wound upon an end form upon a magnetic core comprising:

a. winding a first turn of wire in a first position around the core and between successive partitions on said end form;

b. winding a second turn of wire directly upon the first turn of wire and between the same partitions as said first turn;

c. winding a third turn of wire in a second position around the core in line 9, and between sucessive partitions on said end form;

d. winding a fourth turn of wire directly upon the third turn of wire and between the same partitions as said third turn;

e. repeating steps (a), (b), (c), and (d) in successive positions on the core until the coil is completely wound;

f. forming a commutating surface upon the topmost turns of wire the interspaces of said partitions being essentially equal to the diameter of the wire; and all of the turns, including the turns forming the commutating surface, being between the partitions.

* * * * *